US006321677B1

(12) United States Patent
Butler

(10) Patent No.: US 6,321,677 B1
(45) Date of Patent: Nov. 27, 2001

(54) FUEL TANK HOLD DOWN SYSTEM

(75) Inventor: David L. Butler, Ravenna, OH (US)

(73) Assignee: Moeller Marine Products, Twinsburg, OH (US)

( * ) Notice: Subject to any disclaimer, the term of this patent is extended or adjusted under 35 U.S.C. 154(b) by 0 days.

(21) Appl. No.: 09/661,863

(22) Filed: Sep. 14, 2000

Related U.S. Application Data

(60) Provisional application No. 60/153,819, filed on Sep. 14, 1999.

(51) Int. Cl.[7] ..... B63B 1/00
(52) U.S. Cl. ..... 114/343; 220/327; 440/88
(58) Field of Search ..... 114/343; 440/88, 440/52; 220/327, 563; 123/514

(56) References Cited

U.S. PATENT DOCUMENTS 3,924,597 * 12/1975 Hatz et al. ..... 123/198 E
4,836,123 * 6/1989 Grinde et al. ..... 440/3
5,601,205 2/1997 Prechtel et al. .
5,967,868 * 10/1999 Ito et al. ..... 440/111

* cited by examiner

*Primary Examiner*—Jesus D. Sotelo
(74) *Attorney, Agent, or Firm*—Howard & Howard

(57) ABSTRACT

A vibration dampened fuel tank assembly includes a fastener system and a fuel tank having integrated retention areas for horizontal and/or vertical retention to a fixed surface. Each retention area includes an access area that leads to a mounting lip having a semi-annular opening for receipt of the fastener system. The fastener system preferably includes a bolt-like member, a compression surface and a vibration dampening member, wherein the vibration dampening member has a first and a second diameter such that the first diameter fits within the mounting lip opening while the second diameter overlies the mounting lip. When mounted, the fastener system is engaged to the mounting lip of the fuel tank and affixes to a fixed surface such as a floor or sidewall. The fuel tank assembly, thereby, effectively secures the fuel tank and dampens the repetitive vibrations typically associated with the dynamic watercraft environment.

18 Claims, 3 Drawing Sheets

FUEL TANK HOLD DOWN SYSTEM

This application claims the benefit of provisional application No. 60/153,819, filed Sept. 14, 1999.

BACKGROUND OF THE INVENTION

The present invention relates to a fuel tank assembly, and more particularly to a vibration dampened fuel tank assembly having an integrated hold down system that may be molded directly into the fuel tank. Such a vibration dampened fuel tank assembly is particularly useful for vehicles that are subject to continuous repetitive vibrations such as watercraft.

Motorized watercraft are typically powered by an outboard engine that has a separate fuel tank. The fuel tank is commonly made from a plastic material such as polyethylene and is mounted within the watercraft by individual metal brackets that hold the fuel tank in place. The brackets are typically attached to a fixed surface of the watercraft such as the floor or a bulkhead and hold the fuel tank by sandwiching it between a portion of the bracket and the fixed surface.

During operation of the watercraft, however, these brackets are subject to significant stresses and often bend and/or pull away from their mounting points. For example, during sharp turns, the fuel in the fuel tank shifts back and forth. The momentum of the fuel within the fuel tank causes the tank to repetitively act against the brackets. The brackets can thereby become bent away from the tank and lead to the possibility that the tank will break free. Alternatively, the brackets themselves can pull away from the boat floor.

Accordingly, it is desirable to provide a fuel tank assembly that can effectively secure a fuel tank to a fixed surface while absorbing vibrations typical of the vehicle's environment.

SUMMARY OF THE INVENTION

The present invention is directed to addressing the abovementioned needs by providing a fuel tank assembly that securely affixes a fuel tank to a fixed surface and is capable of dampening high stress vibrations such as may be typically encountered in the dynamic operational environment of a watercraft.

The fuel tank assembly of the present invention generally includes a fuel tank that has integrated retention areas for horizontal and/or vertical retention of a fuel tank and a fastener system that is capable of dampening high stress vibrations typical of the environment in which a watercraft operates. The fuel tank is preferably manufactured from a plastic material so that the integrated retention areas can be molded into and specifically located on the fuel tank. By doing so, the fuel tank assembly may be used in a variety of watercraft and other vehicles. While the fuel tank may be made from any suitable plastic material, it is preferred that the fuel tank be made from a polyethylene such as high density polyethylene (HDPE).

The retention areas are recessed in the exterior wall of the fuel tank and include an access area and a mounting lip. The access area leads from the exterior wall to the mounting lip. The access area provides a space for the fastener system to be inserted and removed from the mounting lip and access of a tool to attach and detach the fastener system, as necessary. The preferred configuration of the access areas are as further described below. The mounting lip is preferably a U-shaped semi-annular opening with a protruding rim for receipt of the fastener system. The fastener system comprises a boltlike like member, at least one compression surface, and at least one vibration dampening member. The vibration dampening member preferably has a first and a second diameter wherein the first diameter fits within the mounting lip opening while the second diameter overlies the mounting lip. It is preferred that the bolt-like member and the compression surface be selected from a rigid material such as for example steel or a resin and the vibration dampening member be selected from a compressible material such as an elastomer. In a preferred embodiment of the present invention, the bolt-like member is a steel bolt or screw, the compression surface is a steel ring-type washer, and the vibration dampening member is a rubber bushing.

When mounted, the vibration dampening member fits within the mounting lip opening and the bolt-like member passes through the compression surface and vibration dampening member to engage a fixed surface such as a watercraft floor or bulkhead to securely mount the fuel tank. When the bolt-like member is tightened, the vibration dampening member is compressed axially by the washer such that the vibration dampening member expands radially to further engage the mounting lip opening. Accordingly, the fuel tank is effectively secured and the vibration dampening member absorbs the repetitive vibration of the watercraft's environment.

In a preferred embodiment, the fuel tank assembly of the present invention comprises a HDPE fuel tank that is molded to have an inner volume for storing fuel and an exterior wall. The exterior wall is generally in the shape of a six-sided box with each side having a substantially planar surface. Two of the planar sides include recessed retention areas that are each capable of receiving a fastener assembly comprised of a bolt, washer and rubber bushing. Each retention area is further located at vertical and horizontal corners, respectively, of the box.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
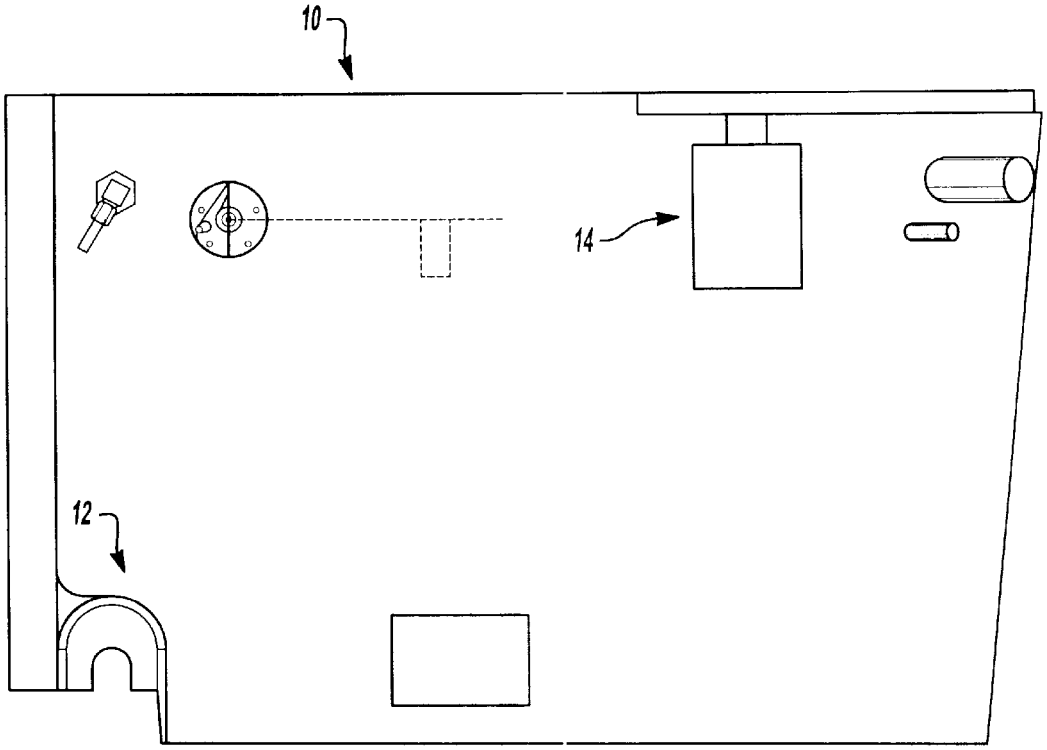
FIG. 1 is a top view of a fuel tank having retention areas according to the present invention.

FIG. 1 illustrates a top view of a fuel tank 10 according to the present invention. The fuel tank 10 includes integrated recessed retention areas and is preferably manufactured from a polyethylene. Fuel tank 10 provides a horizontal retention area 12 and a vertical retention area 14. While one vertical and one horizontal retention area are shown herein, it is specifically contemplated that the fuel tank assembly of the present invention may include any number or combination of retention areas. By manufacturing the fuel tank from a polyethylene or like material, the retention areas can be integrally molded and specifically located on the fuel tank for use by a variety of watercraft or other vehicles.

Figure 2:
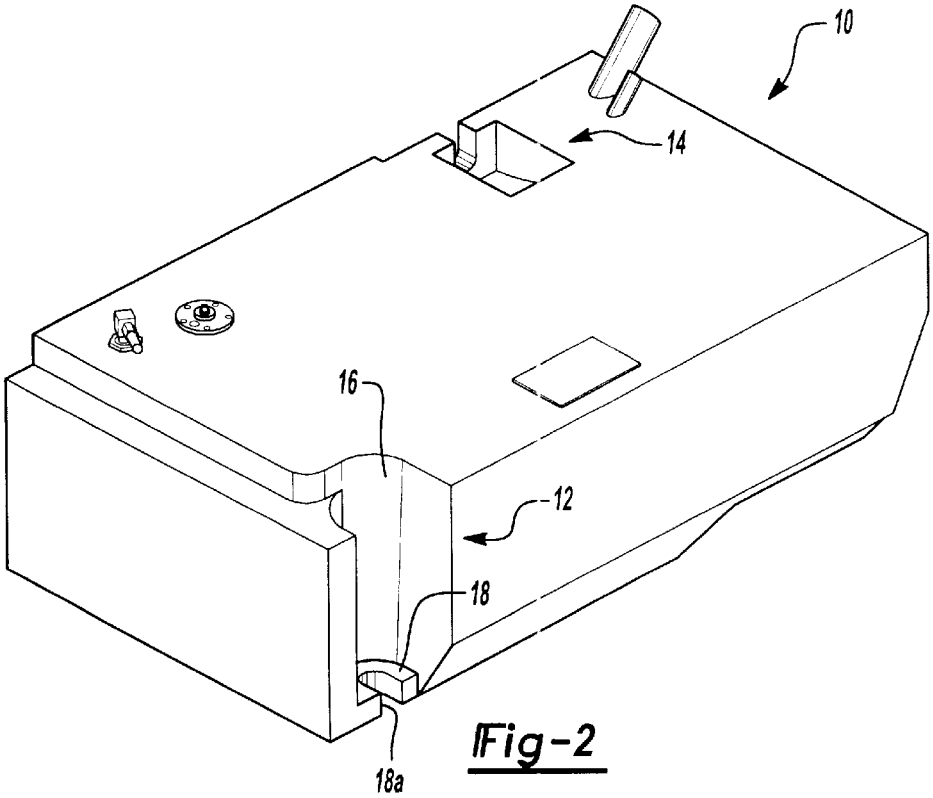
FIGS. 2 and 3 are general perspective views of a fuel tank having horizontal and vertical retention areas according to the present invention.

FIG. 2 illustrates a perspective view of fuel tank 10 with a horizontal retention area 12 that provides an access area 16 and a protruding rim-shaped mounting lip 18 having a U-shaped semi-annular opening 18*a* for receipt of a fastener system 20 (see FIG. 5) further described below. Access area 16 leads to mounting lip 18 so that a tool (not shown) can easily reach fastener system 20. As shown, it is preferred that access area 16 be generally defined by a semi-cylindrical passage leading from the exterior wall of fuel tank 10 to mounting lip 18. As shown in FIGS. 1 and 2, horizontal retention area 12 is preferably located at a corner of fuel tank 10 so that fastener system 20 can engage a fixed horizontal surface such as a watercraft floor (not shown).

Figure 3:
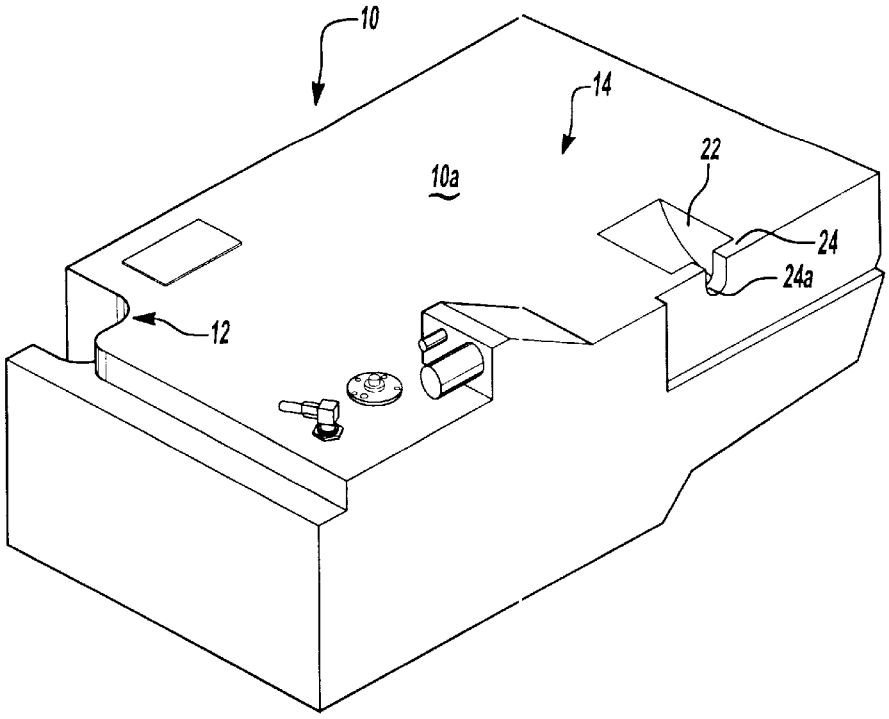
Figure 4:
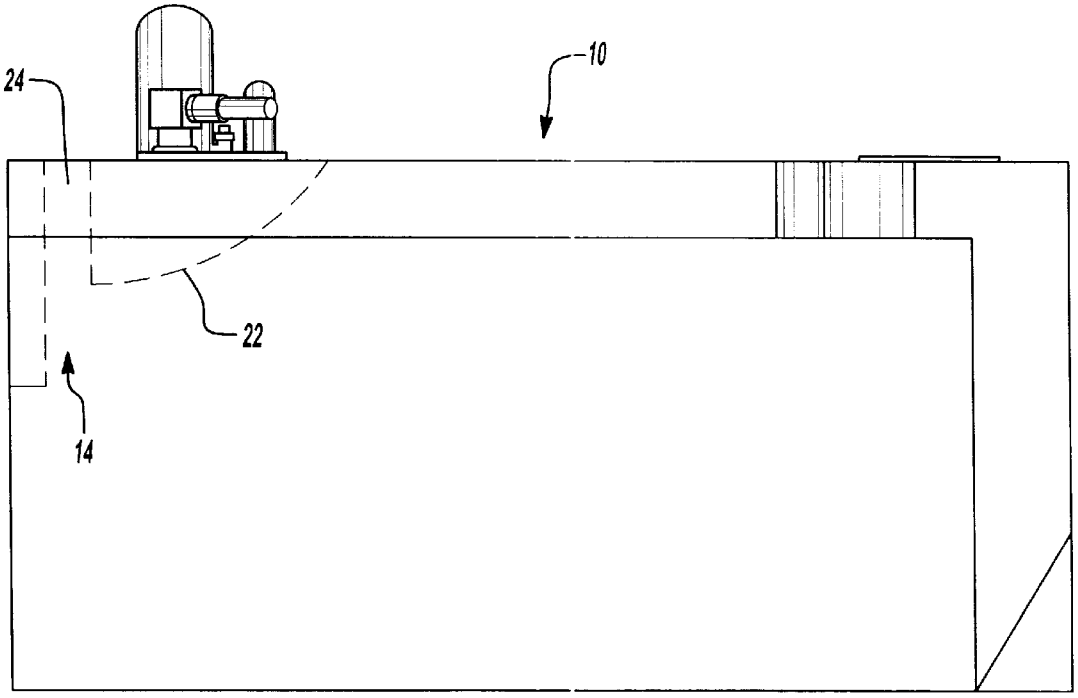
FIG. 4 is a side view of the fuel tank of FIGS. 2 and 3 showing a vertical retention area according to the present invention.

FIG. 3 shows a perspective view of fuel tank 10 with a vertical retention area 14. Vertical retention area 14 similarly provides an access area 22 that leads to a protruding rim-shaped mounting lip 24 having a U-shaped semi-annular opening 24*a* for receipt of the fastener system 20. Access area 22 is configured to allow fastener system 20 to engage a fixed vertical surface such as a watercraft bulkhead or sidewall (not shown). FIG. 4 more clearly shows recessed retention area 14, access area 22 and mounting lip 24. Access area 22 is preferably arcuate such that fastener system 20 may be easily attached to fuel tank 10 while providing adequate tool access to fastener system 20.

Figure 5:
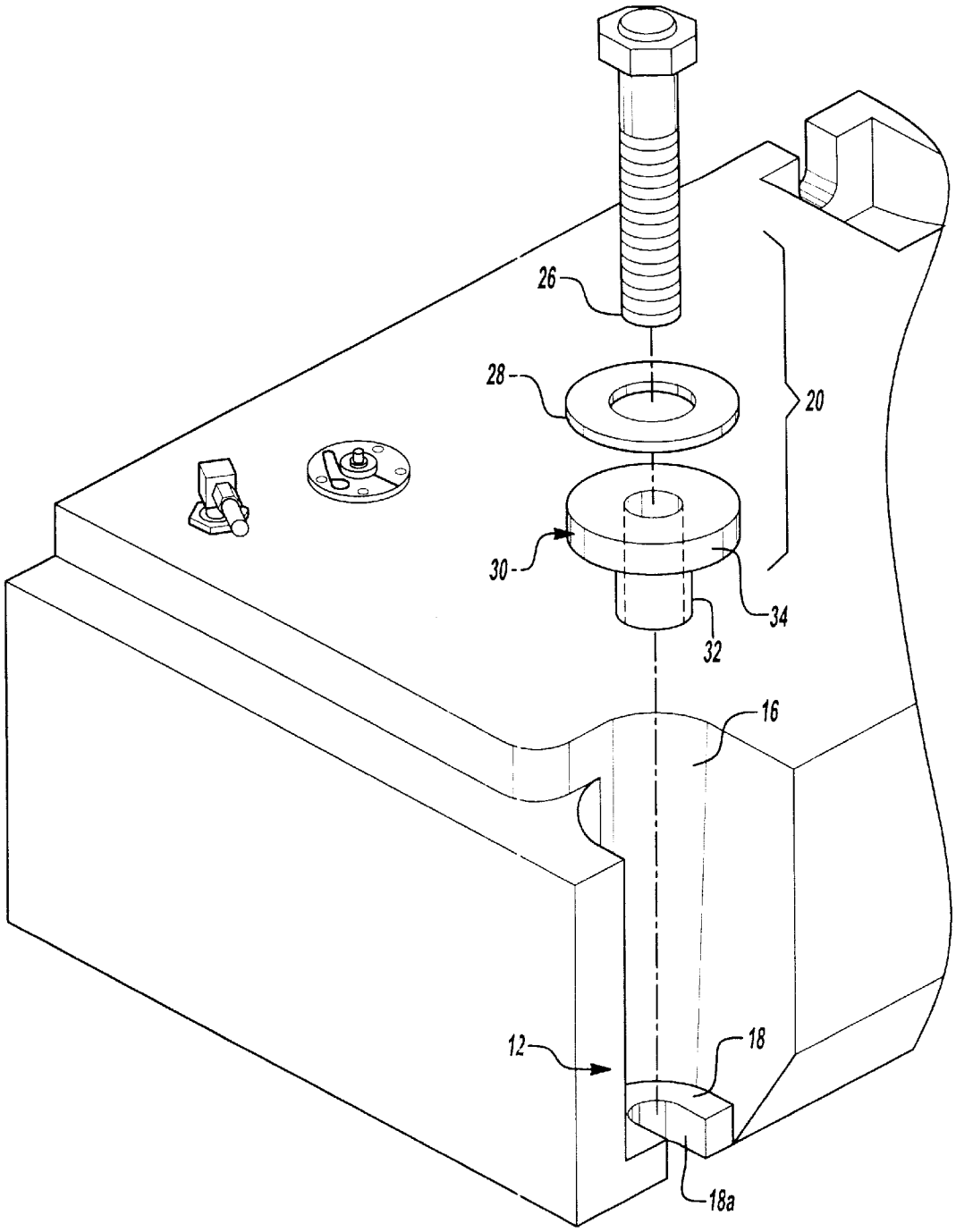
FIG. 5 is an exploded view of a fuel tank assembly of the present invention including the fuel tank, a horizontal retention area, and a fastener system.

FIG. 5 provides an exploded view of the fuel tank assembly including fuel tank 10 and fastener system 20. Fastener system 20 generally comprises a bolt-like member 26, a compression surface 28 and a vibration dampening member 30. The vibration dampening member 30 preferably comprises a compressible material that has a first diameter 32 and a second diameter 34 in which the first diameter 32 fits within the mounting lip opening 18*a,* 24*a* while the second diameter 34 rests on the mounting lip 18, 24. In a preferred embodiment, vibration dampening member 30 comprises an elastomeric material such as rubber.

When fuel tank 10 is mounted, the first diameter 32 fits within the mounting lip opening 18*a,* 24*a,* the second diameter 34 overlies the mounting lip 18, 24 and bolt-like member 26 passes through compression surface 28 and vibration dampening member 30. Bolt-like member 26 is then engaged with a fixed surface of the watercraft to securely mount fuel tank 10.

When bolt-like member 26 is tightened, vibration dampening member 30 is compressed axially by compression surface 28 such that vibration dampening member 30 expands radially to further engage mounting lip opening 18*a,* 24*a* and mounting lip 18, 24. Accordingly, fuel tank 10 is effectively secured to the fixed surface by the fastener system 20 while the vibration dampening member 30 dampens the repetitive vibrations typical to watercraft environment.

While the invention has been shown and described in its preferred embodiments, it will be clear to those skilled in the arts to which it pertains that many changes and modifications may be made thereto without departing from the scope of the invention. Modifications which fall within the true scope of this invention are intended to be included within the terms of the appended claims.

What is claimed is:

1. A vibration dampened fuel tank assembly for a watercraft, comprising:

a plastic fuel tank having an interior volume for storing fuel therein and an exterior wall, a portion of said exterior wall which includes at least one recessed retention area wherein said retention area further comprises an access area leading from said exterior wall to a mounting lip and wherein said mounting lip includes a semi-annular opening, and at least one fastener system for releaseably securing said fuel tank to a fixed surface of a watercraft, wherein said fastener system comprises a bolt-like member, at least one compression surface and at least one vibration dampening member wherein said bolt-like member, compression surface and vibration dampening member are capable of being connected and attached to said mounting lip of said retention area of said fuel tank.

2. A fuel tank assembly of claim 1 further including a second recessed retention area and a second fastener system wherein said retention areas are located proximally to opposing corners of said fuel tank and at least one retention area is oriented to attach to a vertical surface and at least one retention area is oriented to attach to a horizontal surface.

3. A fuel tank assembly of claim 2 wherein at least one of said retention area defines a partially cylindrical passage.

4. A fuel tank assembly of claim 2 wherein at least one of said retention area defines an arcuate passage.

5. A fuel tank assembly of claim 2 wherein the bolt-like member of said fastener system is attached at said mounting lip so that said bolt-like member passes through said semi-annular opening to secure said fuel tank to a fixed surface.

6. A fuel tank assembly of claim 1 wherein the bolt-like member is threaded at the end that attaches to the fixed surface.

7. A fuel tank assembly of claim 6 wherein said threaded end of said bolt-like member terminates in a point that may be driven into a fixed surface.

8. A fuel tank assembly of claim 7 wherein said bolt-like member is a threaded bolt or screw.

9. A fuel tank assembly of claim 1 wherein the compression surface is a ring-type washer.

10. A fuel tank assembly of claim 1 wherein the vibration dampening member has a first diameter and a second diameter wherein said first diameter circumscribes a portion of the bolt-like member and the second diameter underlies the compression surface.

11. A fuel tank assembly of claim 10 wherein said first diameter of said vibration dampening member extends in length along the bolt portion of said bolt-like member to interpose between said fuel tank and the fixed surface of the watercraft.

12. A fuel tank assembly of claim 10 wherein said vibration dampening member comprises an elastomeric material.

13. A fuel tank assembly of claim 12 wherein said vibration dampening member comprises a rubber bushing.

14. A vibration dampened fuel tank assembly for a watercraft, comprising:

a plastic fuel tank having an interior volume for storing fuel and an exterior wall defined by a box-like structure having at least six sides, wherein each side comprises a planar surface, and wherein a portion of at least two of said planar surfaces each include at least one recessed retention area wherein each retention area is located proximally to a corner of said box-like structure, defined by the intersection of at least three adjacently joined planar surfaces, and wherein each retention area includes an access area that leads from said exterior wall to a protruding rim-shaped mounting lip and a U-shaped semi-annular opening at its terminal end to which a fastener system may be releaseably attached; and at least two fastener systems for securing said fuel tank, wherein each fastener system comprises a bolt-like member, at least one compression surface and at least one vibration dampening member wherein said bolt-like member, compression surface and vibration dampening member are capable of being connected to said mounting lip and through said semi-annular opening to secure said fuel tank to a fixed surface of a watercraft.

15. A fuel tank assembly of claim 14 wherein said retention areas are located proximally to opposing corners of said fuel tank and at least one retention area is oriented to attach to a vertical surface and at least one retention area is oriented to attach to a horizontal surface.

16. A fuel tank assembly of claim 15 wherein at least one of said retention area defines a partially cylindrical passage and at least one of said retention area defines an arcuate passage.

17. A fastener system of claim 14 wherein said bolt-like member is a threaded bolt or screw, said compression surface is a ring-type washer and said vibration dampening member is a rubber bushing.

18. A vibration dampened fuel tank assembly for a watercraft, comprising:

a high density polyethylene fuel tank having an interior volume for storing fuel and an exterior wall, said exterior wall includes at least two recessed retention areas, defined by the said retention areas include an access area that leads from said exterior wall to a protruding rim-shaped mounting lip and a U-shaped semi-annular opening at its terminal end to which a fastener system may be releaseably attached, and wherein at least one retention area is oriented to attach to a vertical surface and defined by an arcuate passage and at least one retention area is oriented to attach to a horizontal surface and defined by a partially cylindrical passage; and at least two fastener systems for securing said fuel tank, wherein each fastener system comprises a bolt-like member selected from a bolt or screw, at least one compression surface that is a ring-type washer and at least one vibration dampening member that is a rubber bushing wherein said bolt-like member, compression surface and vibration dampening member are capable of being connected to said mounting lip and through said semi-annular opening to secure said fuel tank to a fixed surface of a watercraft.

* * * * *